US008574103B2

(12) United States Patent
Nagler

(10) Patent No.: US 8,574,103 B2
(45) **Date of Patent: *Nov. 5, 2013**

(54) BALL-STRIKING IMPLEMENT

(75) Inventor: Hubert Nagler, Hollabrunn (AT)

(73) Assignee: TEC Sportmanagement AG, Zug (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/592,257

(22) Filed: Aug. 22, 2012

(65) Prior Publication Data

US 2012/0322590 A1 Dec. 20, 2012

Related U.S. Application Data

(63) Continuation of application No. 12/667,641, filed as application No. PCT/IB2008/052325 on Jun. 12, 2008, now Pat. No. 8,333,672.

(30) Foreign Application Priority Data

Jul. 4, 2007 (CH) ..... 1075/07

(51) Int. Cl.
*A63B 51/00* (2006.01)

(52) U.S. Cl.
USPC ..... 473/542; 473/540

(58) Field of Classification Search
USPC ..... 473/524, 540–542
See application file for complete search history.

(56) References Cited

U.S. PATENT DOCUMENTS

| | | | | |
|---|---|---|---|---|
| 1,559,986 A | | 11/1925 | Quick | |
| 2,456,023 A | | 12/1948 | Rosenbalm | |
| 3,547,440 A | | 12/1970 | Deer et al. | |
| 3,664,669 A | * | 5/1972 | Latham et al. | 473/541 |
| 3,815,660 A | | 6/1974 | Gallagher et al. | |
| 3,874,667 A | * | 4/1975 | Gallagher et al. | 473/541 |
| 3,912,267 A | * | 10/1975 | Lyon | 473/541 |
| 3,966,207 A | * | 6/1976 | Pass | 473/541 |
| 3,981,502 A | * | 9/1976 | Portz | 473/541 |
| 4,005,862 A | | 2/1977 | Portz et al. | |
| 4,185,822 A | * | 1/1980 | Li | 473/541 |
| 4,366,959 A | * | 1/1983 | Lacoste | 473/541 |
| 4,441,712 A | * | 4/1984 | Guthke | 473/541 |
| 4,568,084 A | * | 2/1986 | Mott | 473/541 |
| 4,935,185 A | * | 6/1990 | Mott | 264/257 |
| 5,143,669 A | * | 9/1992 | Mott | 264/103 |
| 5,310,180 A | * | 5/1994 | Wu | 473/523 |
| 5,312,115 A | * | 5/1994 | Wu | 473/541 |
| 5,921,873 A | * | 7/1999 | Brown | 473/540 |
| 6,062,994 A | * | 5/2000 | Grimes et al. | 473/540 |
| 6,440,015 B1 | * | 8/2002 | Chang | 473/540 |
| 7,371,197 B1 | * | 5/2008 | Yu | 473/539 |
| 2002/0098924 A1 | * | 7/2002 | Houser et al. | 473/524 |
| 2009/0227403 A1 | * | 9/2009 | Chang | 473/540 |
| 2010/0190591 A1 | * | 7/2010 | Nagler | 473/535 |

FOREIGN PATENT DOCUMENTS

EP 1 790 392 A1 5/2007

* cited by examiner

*Primary Examiner* — Raleigh W Chiu
(74) *Attorney, Agent, or Firm* — Janet Sleath; Speckman Law Group PLLC

(57) ABSTRACT

A ball-striking implement, in particular a tennis, squash or badminton racket, is described, the implement having a head frame including an impact surface and a stem, which is formed integrally thereon and has a handle, the impact surface being determined by at least one string which is stretched crosswise and forms string portions fastened to the head frame substantially parallel to one another. The string portions are guided in holding elements on the inside of the head frame such that the string portions are positioned in a single plane forming the impact surface.

7 Claims, 3 Drawing Sheets

BALL-STRIKING IMPLEMENT

REFERENCE TO RELATED APPLICATIONS

The present application is a continuation of U.S. patent application Ser. No. 12/667,641, filed Jan. 4, 2010, which is the U.S. national phase entry of International Patent Application no. PCT/IB2008/052325, filed Jun. 12, 2008, which claims priority to Swiss Patent Application No. 1075/07, filed on Jul. 4, 2007.

FIELD OF THE INVENTION

The invention relates to a ball-striking implement, in particular a tennis, squash or badminton racket.

BACKGROUND OF THE INVENTION

Conventional ball-striking implements made of plastics material have a head frame with a hollow profile, into which through-holes are drilled. Through these through-holes, the continuous string is stretched crosswise in loops. It is known that the through-holes, on the one hand, mechanically weaken the head frame and, on the other hand, chafe the string or string portions, as a result of which the string or string portions can tear there under high loads. Therefore, the through-holes are provided with individual eyes or eye bands made of a soft thermoplastic polymer.

Rackets are also known with a central strip made of thermoplastic polymer which is less hard than or as hard as the string. Hollow profiles made of fibre-reinforced plastics material are formed integrally on the central strip on both sides. The through-holes are in this case drilled into the central strip or prefabricated, for example with channels produced or pressed by injection molding.

In order to avoid these drawbacks, EP-A-0142286 discloses a tennis racket which is manufactured by injection molding and has shaped therein a wire with rectangular eyes into which the string is stretched crosswise. The rectangular eyes are in this case arranged in the plane of the impact surface. As the head frame is pear-shaped in its embodiment and the rectangular eyes are arranged with the upper rims substantially parallel to the inside of the head frame, the string is drawn during stringing into either the left or right corner of the respective eyes. It is therefore difficult, if not impossible, to achieve uniform stringing of the tennis racket. Furthermore, the respective string portions are as a result not all positioned in the same plane, as they are drawn around the eyes, making it almost impossible to achieve a stringing or impact surface that is precisely plane-parallel to the head frame.

SUMMARY OF THE INVENTION

The present invention is therefore based on the object of improving a ball-striking implement of the aforementioned type in such a way as to provide uniform stringing of the head frame, as a result of which it is immaterial whether the ball is hit at the center or at the ends of the racket.

This object is achieved by a ball-striking implement with a head frame comprising an impact surface and a stem which is formed integrally thereon and has a handle, the impact surface being determined by at least one string which is stretched crosswise and forms string portions fastened to the head frame substantially parallel to one another, wherein the string portions are guided in holding elements on the inside of the head frame in such a manner that the string portions are positioned in a single plane forming the impact surface.

BRIEF DESCRIPTION OF THE DRAWINGS

Further advantages of the invention emerge from the following description in which the invention is described in greater detail based on an exemplary embodiment illustrated in the schematic drawings, in which.

In the figures, like reference numerals are in each case used for like elements and, unless otherwise specified, initial explanations apply to all the figures.

DETAILED DESCRIPTION

Figure 1:
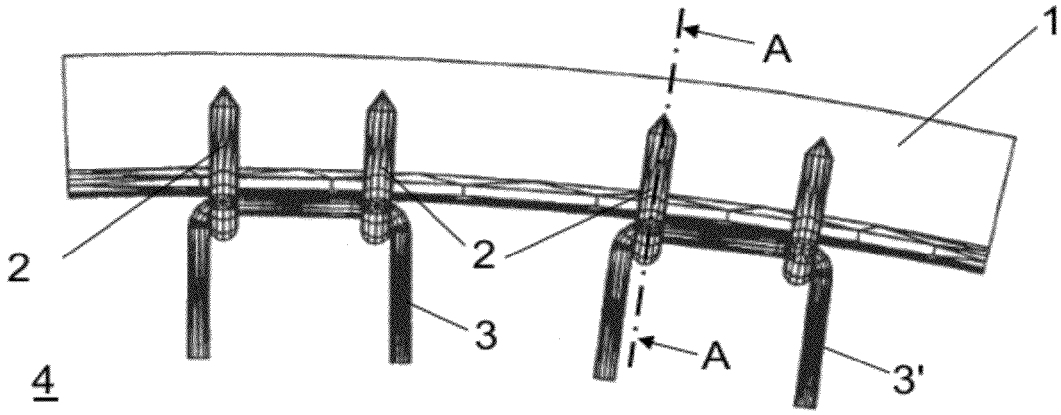
FIG. 1 shows a detail of a first head frame of a tennis racket.

FIG. 1 shows purely schematically a detail of a head frame 1 of a tennis racket known per se with four holding elements 2 in the form of eyes and strings 3 and 3' stretched respectively into two adjacent eyes. As may be seen, the eyes 2 are fastened to the head frame in such a way that the ring surface of the eyes 2 is positioned substantially perpendicularly to the plane 4 of the frame in which the tennis racket is strung.

Figure 2:
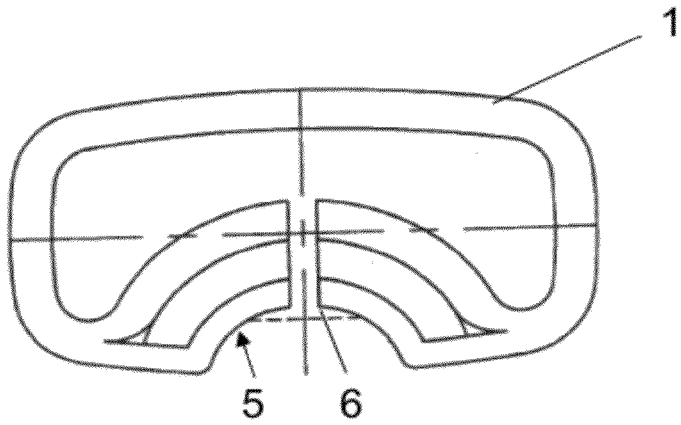
FIG. 2 is a cross section through the head frame along the line A-A in FIG. 1.

FIG. 2 is a cross section through the head frame 1 along the line A-A in FIG. 1. As may clearly be seen, the head frame 1 is hollow in its embodiment and has on the interior side a peripheral, sector of a ring-shaped, flat groove 5 having a borehole 6 which is formed perpendicularly thereto and serves to receive an eye 2.

Figure 3:
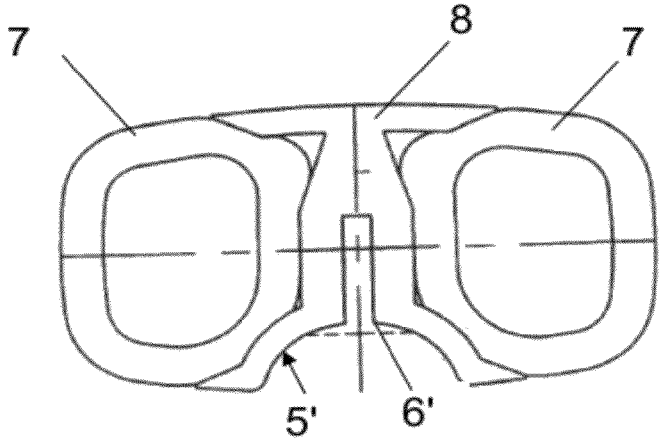
FIG. 3 is a cross section through the head frame in the region of what is known as the core.

FIG. 3 shows the head frame 1 in the region of what is known as the core of the tennis racket, in which the two frame parts 7 have a smaller diameter and these frame parts 7 enclose an H-shaped center part 8 which also has a similar sector of a ring-shaped, flat groove 5' and a borehole 6' for receiving an eye 2.

Figure 4:
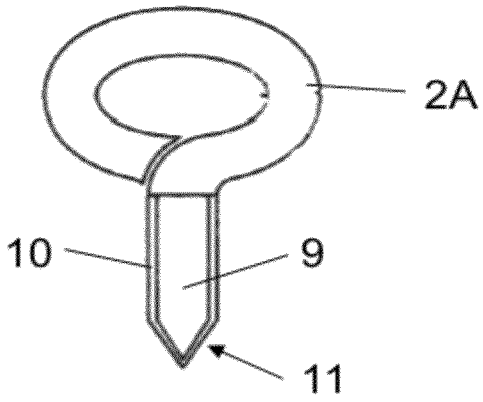
FIGS. 4 to 6 show various embodiments of the inserted eyes.
Figure 5:
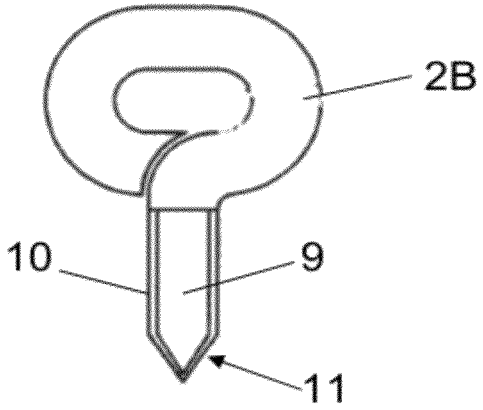
Figure 6:
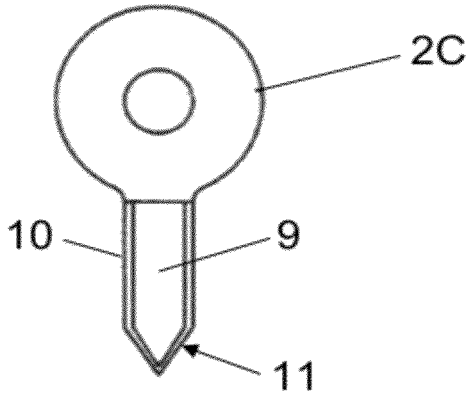

FIG. 4 shows an oval-shaped eye 2A, FIG. 5 shows an elliptical eye 2B and FIG. 6 shows a circular eye 2C. The stem 9 of these eyes 2A to 2C is in each case provided with a screw thread 10 and a front tip 11 in order to be inserted more easily into the borehole 6.

Figure 7:
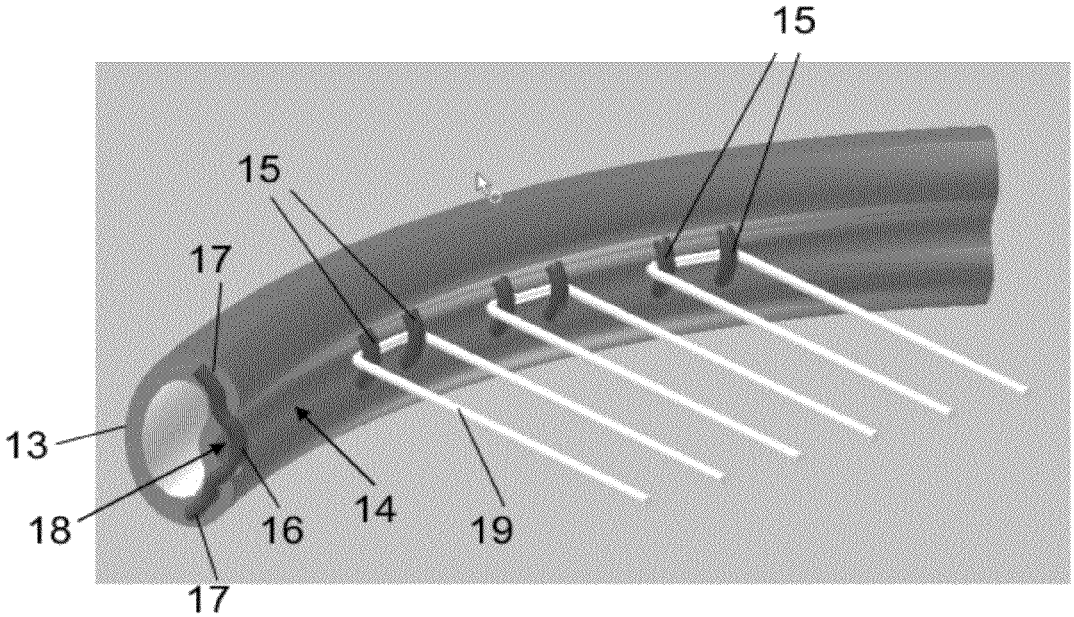
FIG. 7 is a perspective view of a detail of a second head frame.

FIG. 7 shows a second variant of a head frame 13 which is also hollow in its embodiment and has a sector of a circle-shaped, flat groove 14. Holding elements, in this case in the form of arcuate individual parts or bows 15 having a sector of a circle-shaped center part 16 and two curved legs 17 corresponding to the curvature of the head frame 13 in the region of the upper inner and lower inner edge, are also provided in this head frame. Thus, the bow 15 forms with the flat groove 14 an oval opening 18 through which the string 19 of the stringing is passed. The bows 15 are fully integrated in the head frame 13 which is manufactured by laminating with what are known as prepregs or by injection molding.

Figure 8:
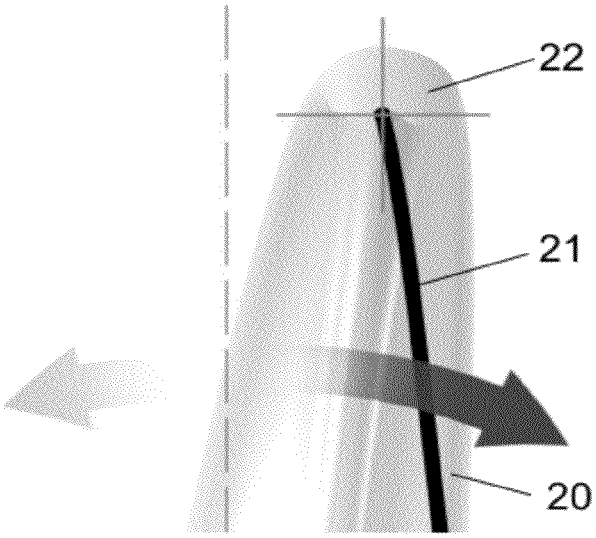
FIG. 8 is a schematic view of a conventional tennis racket at the moment of hitting the ball.

Now, FIG. 8 shows a frame detail 20 of a conventional tennis racket, with stringing through through-bore holes (not visible) provided in the head frame. As a result of the fact that the string 21 is fixed at its end 22 to the head frame 20, a ball striking the stringing will deflect the head frame, so that the ball bounces off not perpendicularly to the plane of the racket (rest position), but at an angle of approximately 80°. A professional tennis player can compensate for a deflection of this type of the head frame 20 using his wrist. The ability to precisely determine the direction of the ball and the speed of the ball requires daily practice and good visual judgment; only first-class tennis players are able to do this.

Figure 9:
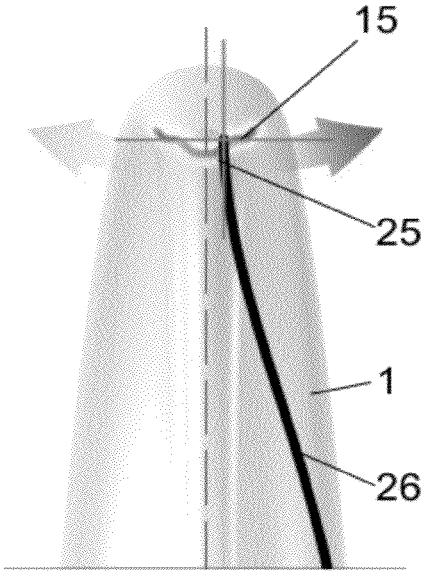
FIG. 9 is a schematic view of a tennis racket according to the invention at the moment of hitting the ball.

Now, FIG. 9 shows the head frame 1 of the tennis racket according to the present invention, the stretched-in end 25 of the string in the bow 15 performing a lateral movement caused by the impact of the tennis ball. As a result, the energy of the tennis ball is absorbed now by the stringing and no longer by a deflection of the head frame as in FIG. 8. The entire stringing or string bed is thus deflected laterally, allowing much more precise ball control, as the direction of impact is at all times perpendicular to the plane of the racket and the direction of the ball can thus be controlled by the tennis player with a very narrow spread range. It allows tennis players of all abilities to precisely guide the ball without exerting much force. Such stringing has the further advantage that vibrations of the head frame are markedly reduced as a result of the lateral deflection of the strings.

The head frame 1 or 13 of the tennis racket described in the present document is made from a suitable fiber-reinforced plastics material by injection molding. The eyes 2 or bows 15 are selectively made from fiber-reinforced plastics material, metal, such as for example titanium, steel, non-ferrous metal, light metal such as aluminum or alloys thereof, or from a composite of these materials. This also allows the head frame to be made more aerodynamically advantageous.

The invention claimed is:

1. A ball striking implement comprising:

(a) a head frame which is hollow and made from it fiber-reinforced plastics material by injection molding or by laminating, with prepregs the head frame comprising an impact surface determined by at least one string which is stretched crosswise and forms string portions fastened to the head frame substantially parallel to one another by means of arcuate or bow shaped holding elements; and (b) a stem which is formed integrally on the head frame and comprises a handle, wherein the arcuate or bow shaped holding elements are embedded and fully integrated in the head frame and each arcuate or bow shaped holding element has a central part in the shape of a sector of a circle and two curved legs corresponding to the curvature of the head frame in a region of the upper inner edge and lower inner edge of the head frame, and wherein a plane defined by the arcuate or bow shaped holding elements is substantially perpendicular to the impact surface, whereby the string portions are positioned in a single plane forming the impact surface, such that ends of the string portions perform a lateral movement in the arcuate or bow shaped holding elements upon impact of a ball, which results in a lateral deflection of the entire impact surface.

2. the ball striking implement of claim 1, wherein the holding elements are arcuate individual parts and are embedded in the head frame in such a manner that planes defined by the arcuate individual parts are positioned substantially perpendicularly to the impact surface.

3. The ball striking implement of claim 2 wherein the head frame has an inner oval-shaped groove which, together with the arcuate holding elements, forms oval openings for receiving the end of the string portions.

4. A ball striking implement comprising:

(a) ahead frame which is hollow and made from a fiber-reinforced plastics material by injection molding or by laminating with prepregs, the head frame comprising an impact surface determined by at least one string which is stretched crosswise and forms string portions fastened to the head frame substantially parallel to one another by means of holding elements; and (b) a stem which is formed integrally on the head frame and comprises a handle, wherein the holding elements are embedded and fully integrated in the head frame, and are in the form of individual parts comprising a stem and a ring, and wherein the holding elements are fastened by a ring surface to the head frame substantially perpendicularly to the impact surface, wherein a plane defined by the holding elements is substantially perpendicular to the impact surface, whereby the string portions are positioned in a single plane forming the impact surface, such that ends of the string portions perform a lateral movement in the holding elements upon impact of a ball, which results in a lateral deflection of the entire impact surface.

5. The ball striking implement of 4, wherein the ring is circular, oral ellipsoidal in shape.

6. The ball striking implement of claim 4, wherein the head frame comprises an inner peripheral groove in which through-boreholes are formed for receiving the stems of the holding elements.

7. The ball striking implement of claim 4, wherein the head frame consists in the region of the core of two oval-shaped tubular bodies which enclose an H-shaped center part, the center part having blind boreholes for receiving the stems of the holding elements.

* * * * *

UNITED STATES PATENT AND TRADEMARK OFFICE

CERTIFICATE OF CORRECTION

PATENT NO. : 8,574,103 B2
APPLICATION NO. : 13/592257
DATED : November 5, 2013
INVENTOR(S) : Hubert Nagler It is certified that error appears in the above-identified patent and that said Letters Patent is hereby corrected as shown below:

In the Claims

Claim 1, Col. 3, Line 35, Replace “made from it” with --made from a--

Claim 1, Col. 3, Line 37, Replace “laminating, with” with --laminating with--

Claim 5, Col. 4, Line 40, Replace “circular, oral” with --circular, oval or--

Signed and Sealed this
Twenty-eighth Day of January, 2014

Michelle K. Lee

Michelle K. Lee
*Deputy Director of the United States Patent and Trademark Office*